US005553642A

United States Patent [19]

Tillon et al.

[11] Patent Number: 5,553,642

[45] Date of Patent: Sep. 10, 1996

[54] PROCESS AND DEVICE FOR MAKING DECORATED WOVEN-KNITTED TEXTILE BACKING

[76] Inventors: Georges Tillon, La Tuillere, F-42580, La Tour-en-Jarez; Jean Laurent, Le Solita, 21 rue Lisfranc F-42100, Saint Etienne, both of France

[21] Appl. No.: 302,789

[22] PCT Filed: Mar. 10, 1993

[86] PCT No.: PCT/FR93/00232

§ 371 Date: Oct. 7, 1994

§ 102(e) Date: Oct. 7, 1994

[87] PCT Pub. No.: WO93/18216

PCT Pub. Date: Sep. 16, 1993

[30] Foreign Application Priority Data

Mar. 11, 1992 [FR] France ..... 92 03256

[51] Int. Cl.[6] ..... D04B 39/06

[52] U.S. Cl. ..... 139/11; 139/383 B; 66/193

[58] Field of Search ..... 139/383 B, 11; 66/192, 193

[56] References Cited

U.S. PATENT DOCUMENTS

| | | | |
|---|---|---|---|
| 1,811,081 | 6/1931 | Hartwell | 66/193 |
| 2,136,368 | 11/1938 | Amidon . | |
| 3,746,051 | 7/1973 | Mohelnicky et al. | 139/383 B |
| 4,134,433 | 1/1979 | Horacek et al. | 139/383 B |
| 4,581,905 | 4/1986 | Bonaschi . | |
| 4,608,290 | 8/1986 | Schnegg . | |
| 4,723,424 | 2/1988 | Wunner . | |

FOREIGN PATENT DOCUMENTS

| | | | |
|---|---|---|---|
| 2339011 | 9/1977 | France . | |
| 2420612 | 10/1975 | Germany . | |
| 2059467 | 4/1981 | United Kingdom . | |
| 6463 | 9/1984 | United Kingdom | 66/193 |

*Primary Examiner*—Andy Falik

*Attorney, Agent, or Firm*—Eckert Seamans Cherin & Mellott

[57] ABSTRACT

A textile backing with a decorative weft is manufactured by raising at least one bonding needle across the warp yarn lap of the textile backing, the bonding needle being used to form a locking mesh having a number of loops; retracting the needles under the textile backing; inserting a decorative weft at right angles to the warp yarns; simultaneously raising and shifting the needles and shifting the locking mesh yam in a circular arc movement using binding guides in order to twill the path of the bonding needle, thereby forming a locking mesh for retaining the decorative weft; displacing the binding guides in translation at a top dead center position for flattening the decorative weft yam against the needle; lowering the bonding needles, drawing the mesh-forming yarn, and creating a loop of locking mesh yarn which encloses the decorative weft; and re-shifting the guides in translation at bottom dead center position in preparation for a new cycle.

8 Claims, 9 Drawing Sheets

PROCESS AND DEVICE FOR MAKING DECORATED WOVEN-KNITTED TEXTILE BACKING

BACKGROUND OF THE INVENTION

1. Field of the Invention

The problem which the invention proposes to solve is to provide a textile backing having a decorative effect or effects.

2. Description of the Prior Art

Generally, in known processes, a backing is used which is usually woven on a Jacquard loom, or a meshed backing made on a crochet loom. Such processes make it necessary to use heavy components and complex motion.

In the case of a Jacquard loom shuttles are used, the capacities of which are limited. In addition, in a Jacquard technique speed is limited having regard to the very high mechanical stresses that occur, especially in regard to the sley, which is of the "swivel shuttle attachment" type.

In knitting loom technology, the loom generally employs a beam and a bar guide which constitute a mechanical assembly that necessitates a long setting-up time and reduced production rate.

In both cases, the reserve yarn capacity is very limited, so that it is difficult to make use of yarns of large cross section. Finally and above all, these techniques are poor from the economic point of view and as regards speed.

A process is known from Patent FR 2 339 011 that combines the techniques of a weaving loom with those of a crochet loom. That document essentially describes the formation of a basic textile backing on a loom, with the simultaneous formation of any kind of decorative effect whatsoever. The decorative effect is anchored on to the textile backing by means of locking meshes which are made simultaneously with said backing. However, the solution for achieving these objects is unsatisfactory, since the means for achieving it are so complicated that the results obtained are not satisfactory.

SUMMARY OF THE INVENTION

An object of the invention is to provide a remedy for these drawbacks in a simple, sure, effective and rational way.

The problem that the invention proposes to solve is to obtain a textile backing with decorative effects by using fast looms, including shuttleless looms, in order to obtain very high production rates, by combining the techniques of weaving and stitching.

According to a basic feature of the invention, a process has been conceived and applied, for the automatic manufacture of a textile backing with decorative effects, in which:

a textile backing comprising weft yarns and warp yarns is made on an automatic loom, simultaneously with the formation of the backing, at least one decorative effect is formed and anchored on the textile backing by means of meshes made simultaneously with the basic backing, the bonding needles used in forming the locking mesh are raised across the warp yarn lap of the basic backing, the bonding needles for forming the locking mesh are retracted under the basic textile backing, the decorative weft is inserted at right angles to the warp yarns of the basic textile backing, the bonding needles for forming the locking mesh are shifted and raised again, and simultaneously, the locking mesh yarn is shifted according to a circle arc movement and using binding guides, so as to twill the path of said needles, thereby forming the decorative weft's locking mesh and flattening it against the needles, at the dead center, the binding guides for forming the locking mesh are displaced in translation at right angles to the warp, the needles and the binding guides for forming the locking mesh are simultaneously lowered, drawing the mesh-forming yarns by creation of a loop of meshes enclosing the decorative weft, the decorative weft or wefts are held by the meshes of the warp so as to define portions of the floating decorative weft parallel to the warp, thereby constituting loops of decorative weft which are variable in amplitude and length, in accordance with a predetermined program.

For the application of the process, and for carrying out each of its characteristic steps on any type of high speed loom, the device comprises:

means for distributing the decorative weft or wefts, means for moving the bonding needles for forming the locking mesh in back-and-forth motion so as to subject them to vertical motion in a straight line, respectively on and under the warp and parallel to this latter, constituting a "square" cycle, means for applying motion in an arc of a circle which crosses the path of the needles, to a support or supports that receive the locking mesh yarn, means, or a programmed electronic control unit, for displacing in rectangular motion members adapted to detain temporarily the weft or wefts of the decorative effect, programmable control means adapted to act on the distribution means for the decorative weft so that its displacements can be modified at will.

In order to solve the problem of obtaining decorative effects, the distribution means for the decorative weft or wefts comprise at least one yarn guide supporting said weft, said yarn guide being coupled to a transfer carriage displaceable in straight line motion, control of which is provided by a programmable central unit.

In order to solve the problem of modifying the decorative effect, the yarn guide or guides are fixed on guide bars for the displacement of the carriage in a straight line, at right angles to the warp yarns of the basic textile backing, with the carriage cooperating with a drive system coupled to a programmable motor.

In order to solve the problem of anchoring the decorative effect or effects by means of the locking meshes, the control means for the bonding needles for forming the locking mesh comprise an oscillating support receiving said needles which are mounted in a needle rod, said support cooperating with members for driving and for transforming motion, so as to submit all of said needles to vertical straight line to-and-fro movement through and under the basic textile backing.

With regard to the problem of arranging the decorative effect or effects on the basic backing, the means for applying motion in an arc of a circle to the locking mesh yarn or yarns comprise a system of crank arms and cranks under the control of the support that receives the bonding needles for forming the locking mesh, with said system working through a crank on a shaft, on which the supports that receive the locking mesh yarns are mounted.

The means for displacing, in rectangular motion, the members that are adapted for the temporary retention of the weft or wefts of the decorative effect comprise a deformable parallelogram system.

In order to overcome the problem of distributing the decorative weft on the top of the textile backing, by modifying at will the decorative effects which are obtained, the programmable control means adapted to act on the means for distributing the decorative weft so as to modify its displacement at will, comprise a stepping motor controlled electronically by integrating two parameters, namely an amplitude of the decorative weft in a direction at right angles to the warp yarns and in displacement to right or left, and a frequency of movements, or not, at each revolution of the loom.

BRIEF DESCRIPTION OF THE DRAWING

The invention is described below in greater detail with reference to the accompanying drawings, in which.

DESCRIPTION OF THE PREFERRED EMBODIMENTS

Figure 1:
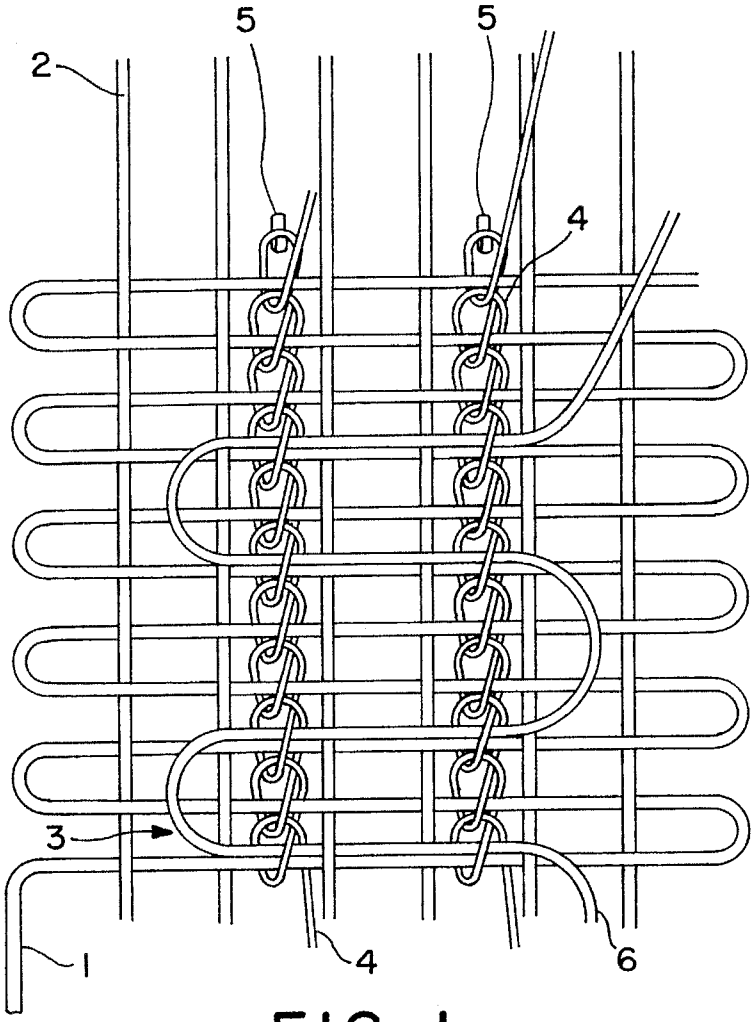
FIG. 1 is a large scale top view showing the principle of the manufacturing process in accordance with the invention.
Figure 3:
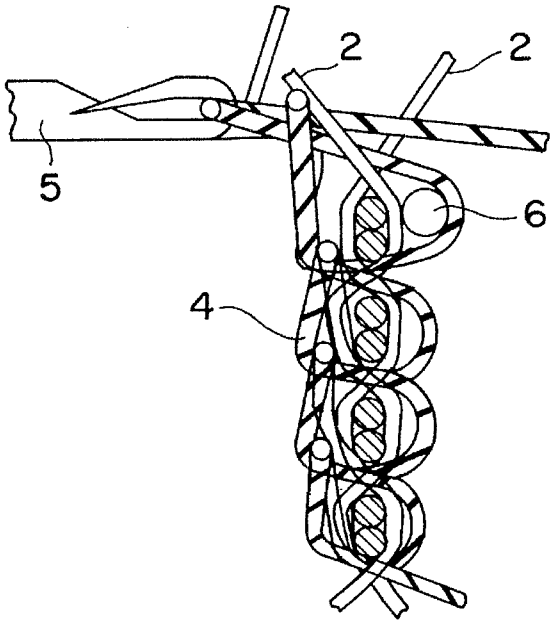
FIG. 3 is a view similar to FIG. 2 for a modified embodiment, in relation to the textile backing in particular.

As is shown in FIG. 1, a textile backing is made on an automatic loom of any known and suitable type, and comprises weft yarns (1) and warp yarns (2). Simultaneously with the formation of the backing, at least one decorative effect (3) is formed and is anchored on the textile backing by means of meshes (4) made simultaneously with the basic backing.

As will be explained in the remainder of the description, the meshes (4) are made by means of needles (5) which are moved in a predetermined way. The decorative effect (3) is obtained by means of a decorative weft (6). Formation of the basic backing, by means of the warp and weft system, is carried out in an entirely conventional way in combination with a comb or reed (P), but it is not described in detail, because firstly this technique is perfectly well known to a person skilled in the art and secondly, it is not part of the specific object of the invention.

The bonding needles (5) for forming the locking mesh (4) are disposed very substantially at right angles to the warp lap or shed (2), and are fixed to a base block (15) or needle bed which is moved in vertical alternating motion.

In accordance with the process of the invention, when the comb (P) is drawn away from the beat-up position, the needles (5) advance parallel to the warp and rise perpendicularly, across the warp yarn lap (2) of the basic backing. When the needles (5) descend and disappear below the warp yarn lap (2) of the basic backing, they are retracted below the latter at the level of insertion of the last pick. This withdrawal of the needles (5) is necessary in order to prevent them from coming into contact with the comb (P), which occupies their position on reaching the beat-up position.

For this purpose, the needle rod (7) slides in two bearings of an oscillating support (8) which is pivoted on an axis (O1). The needle rod (7) is coupled through a crank pin (9) to an assembly comprising a crank arm (10) and crank (11). This assembly (10) (11) is balanced, and receives its motion from a shaft (O2) so as to apply alternating vertical motion to the needle rod (7).

Having regard to the oscillating mounting of the support (8), the needles (5) can be retracted below the base fabric as described.

As far as the oscillating mounting of the support (8) is concerned, this latter is obtained by a system in which a cam (12) is mounted on a shaft (13) and arranged to act on a roller (14), which is secured to said support and offset angularly with respect to the pivot axis (O1). A resilient member of the spring type ensures the return of the support (8).

The needles (5), by withdrawing, tend to block the base weft (1) by means of the mesh. When the needles (5) are below the basic textile backing (1) (2), with the sley of the loom being in the beat-up position, the decorative weft (6) is transferred and laid at right angles to the warp yarns (2). The decorative weft (6) is supported by yarn guides (15) fixed to a carriage (16). For example, according to the decorative effect to be obtained, the arrangement may have four yarn guides (15), each of which is fixed to one carriage (16).

Each of the carriages is mounted for free sliding movement on a bar (17), and on a parallel bar which serves as a guide (18), and the bars (17) and (18) together enable the carriage to move in a straight line at right angles to the warp (2). Each carriage (16) is driven by means of a toothed drive belt (19) mounted on a toothed idle wheel (20) and a toothed drive wheel (21) which is fitted on the shaft of a motor (22). This arrangement is repeated for each of the transfer carriages (16).

According to a major feature of the invention, each of the motors (22) is controlled electronically by being connected to a central programming unit. For example, each motor comprises a stepping motor, used in automatic switching, being of the ESCAP PP 520 type, or a direct current motor. Two Hall effect cells incorporated in the motor permit this type of control.

The program integrates two parameters:

- a weft amplitude in the direction at right angles to the warp yarns, following a displacement to right or left,
- a frequency of movement, or not, at each revolution of the loom.

Figure 4:
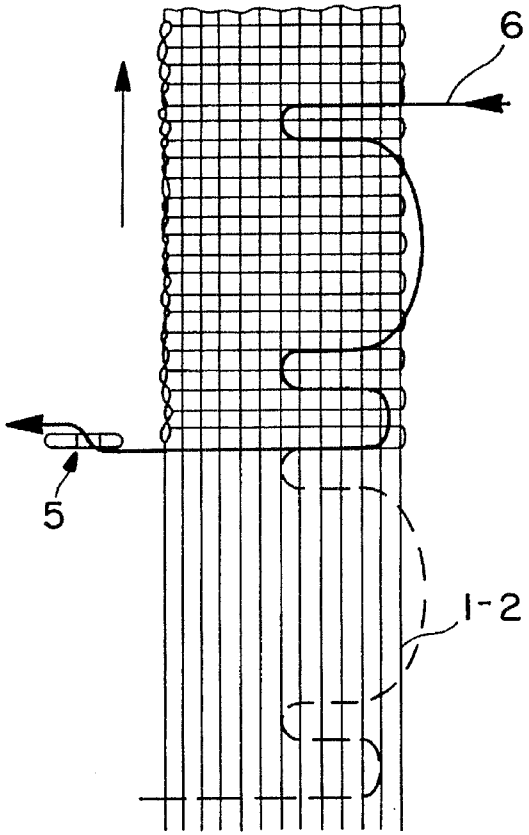
FIG. 4 is a top view showing one example of the manufacture of the article as a function of the selected program.

FIG. 4 shows one example of a decorative effect obtained by the weft (6) in accordance with a predetermined programme for the motors (22).

An arbitrary choice is made of one possibility for movement or rest, for example over 50 revolutions or cycles of the weaving loom, which constitutes the "programme step". An amplitude of movement, which is called the "motor travel", is fixed for each cycle. In the example of the article to be produced shown in FIG. 4, in accordance with the chosen program, the decorative weft (6) is distributed so as to form a small loop at steps 0 to 2, 13 and 15, 15 and 18. This decorative weft (6) forms a large loop between the second and thirteenth steps of the program, and therefore over eighteen loom cycles. On return to 0, the transfer carriage (16) which displaces the decorative weft (6) comes below an electronic position sensor (C), which is adjusted mechanically as may be convenient for the job. The value of the travel of the carriage is fixed so as to put it to the left of the textile backing at the beginning of the work, in position 0, after a number of pulses have been communicated to the motor. Various stations are programmed in accordance with the decorative motif to be obtained.

At step No. 0 of the program, which corresponds to the first cycle of the loom, the carriage is returned to the left, at the value 0. At step No. 1 of the program, this value is maintained in such a way that the carriage remains stationary. At step No. 2 of the program, it starts towards the value 200 pulses, corresponding to the formation of the large loop of the decorative effect, and it maintains this value until the program step No. 13 at which the value reverts to 0, and then, at programme step No. 15, it goes to the value 130 and returns the carriage to the value 0 at step 18, this step being coincident with the step 0 in the programme for the first cycle.

Figure 11:
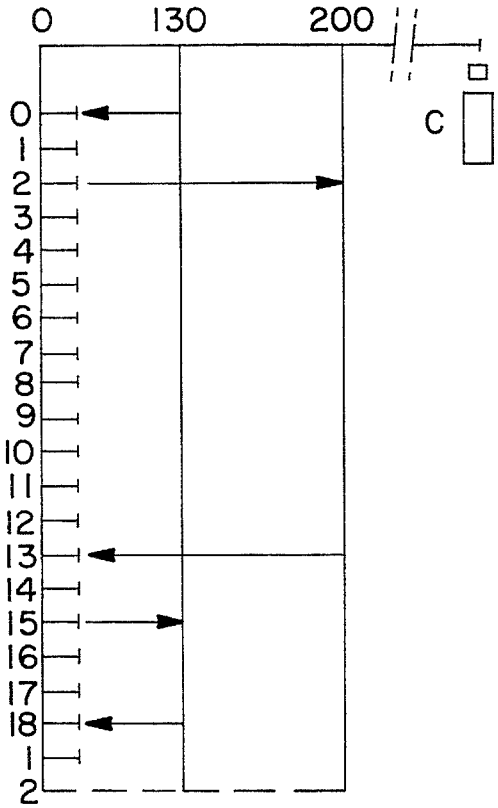
FIG. 11 is a schematic diagram of one example of a programme for the motor controlling the yarn guide for the decorative weft, as a function of the decorative effect obtained.

Reference is made to FIG. 11, which shows one example of programming the motor for controlling the yarn guides for the decorative weft in accordance with the decorative effect to be obtained.

After transfer and laying of the decorative weft (6) on the basic backing, it is convenient to anchor this decorative weft on to said backing by means of the locking mesh yarn (4).

Figure 12:
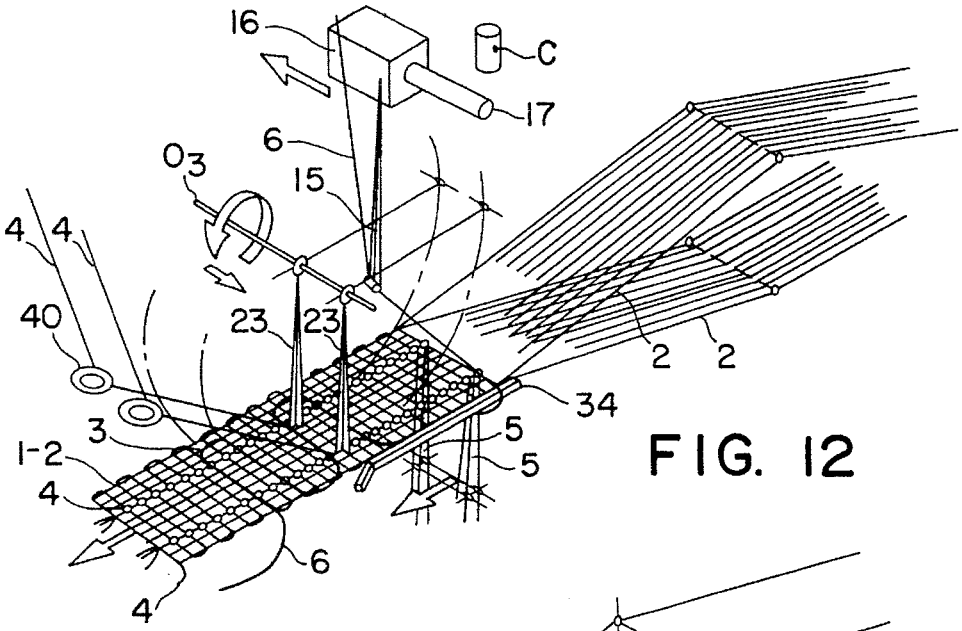
FIGS. 12, 13 and 14 are pictorial views the gripping of the decorative weft between the back of the needles and the locking yarn on the textile backing.
Figure 13:
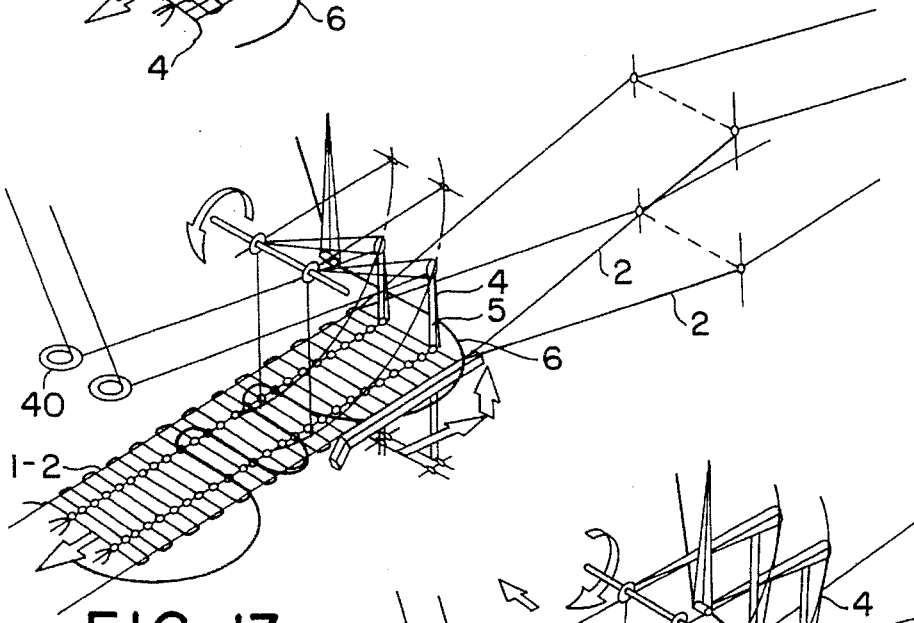
Figure 14:
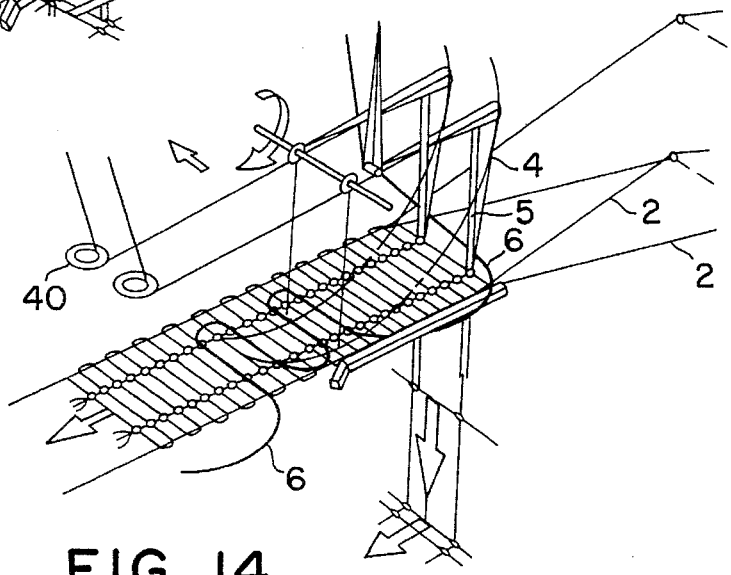

FIGS. 12–14 are sequential pictorial views showing the relative positions of the binding guide s(23) and the needles (5) during a cycle.

To this end, the needles (5) advance and ascend vertically, the comb (P) retracts, and simultaneously, binding guides (23) which receive the yarn from the needles (5) that are arranged to form the locking mesh, are raised in a movement in an arc of a circle which crosses the path of said needles (5). As is shown in FIGS. 12, 13 and 14, these arrangements have the effect of gripping the decorative weft (6). This gripping is effected between the back of the needles (5) and the locking mesh yarns (4) which pass through the yarn guides (40).

Figure 5:
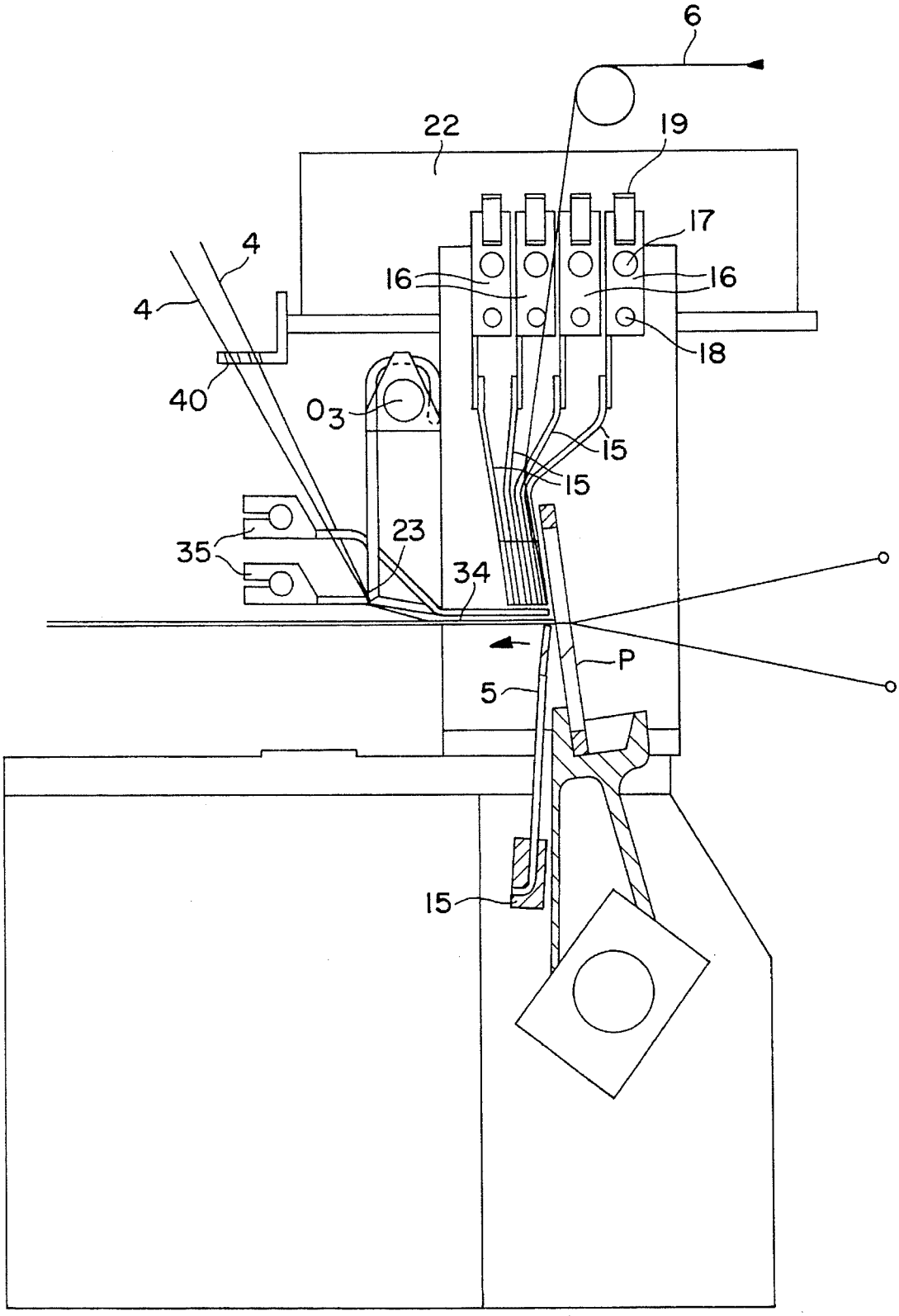
FIG. 5 is a front view of a machine equipped with the device in accordance with the invention.
Figure 6:
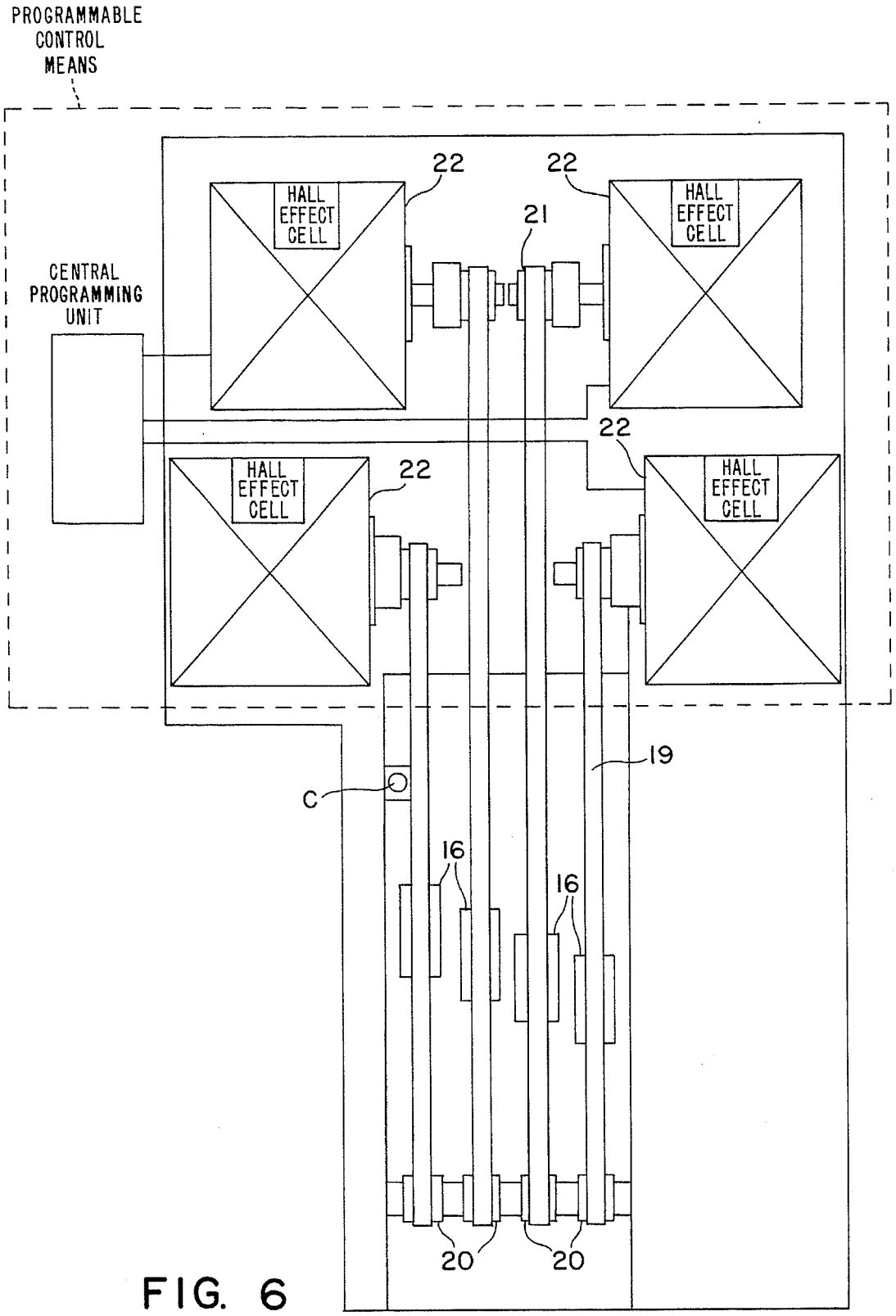
FIG. 6 is a top plan view corresponding to FIG. 5.
Figure 8:
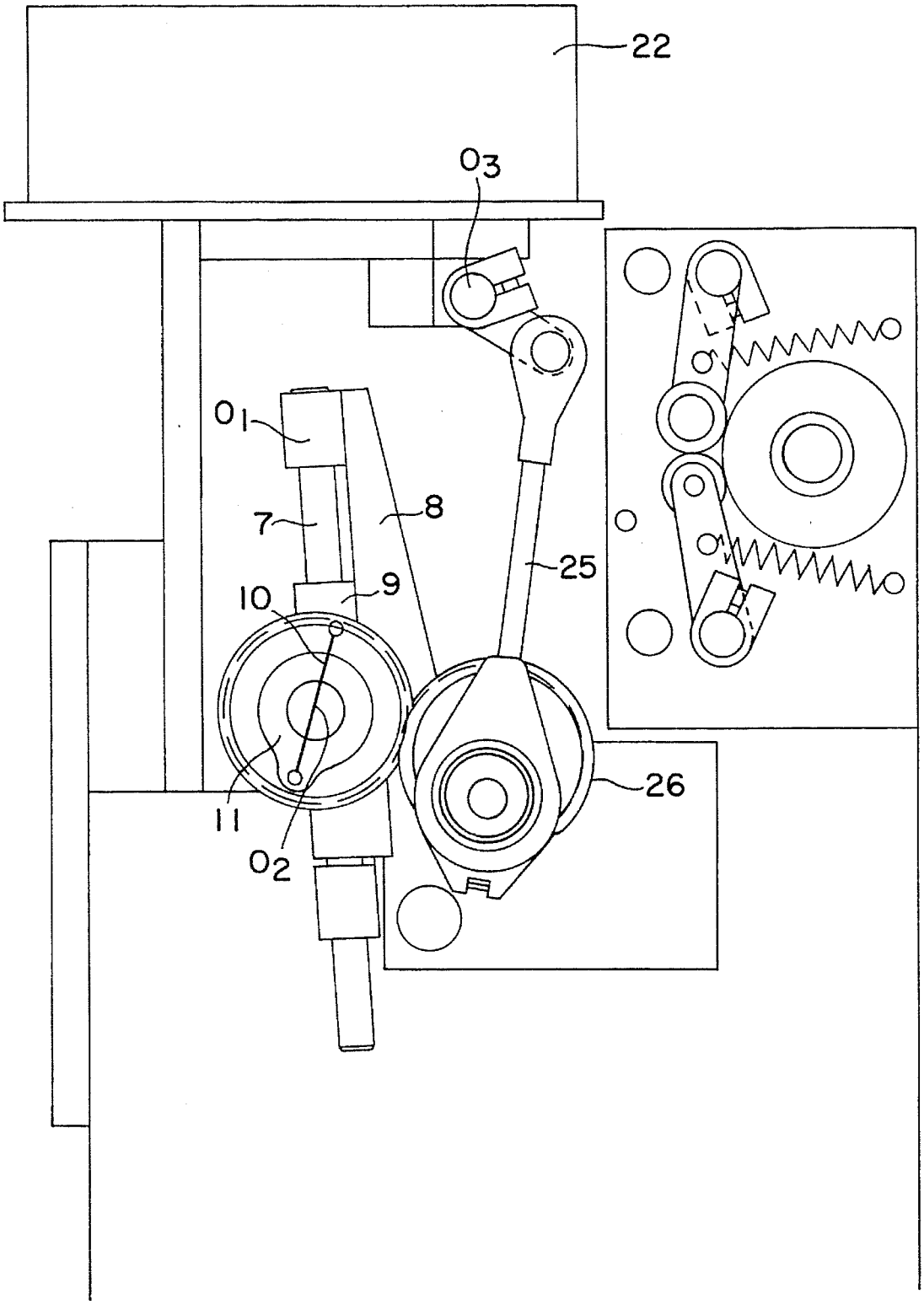
FIG. 8 is a front view showing the means for displacing the bonding needles for forming the locking mesh.

As is shown in FIG. 5 in particular, the binding guides (23) are fixed to a shaft (O3), coupled to a crank (26) so as to be given the oscillating motion through a system comprising a crank arm (25) and crank (26) (FIG. 8). This crank arm and crank assembly is controlled by a system of toothed wheels which is responsive to the movements of the needles from the shaft (O2).

Figure 7:
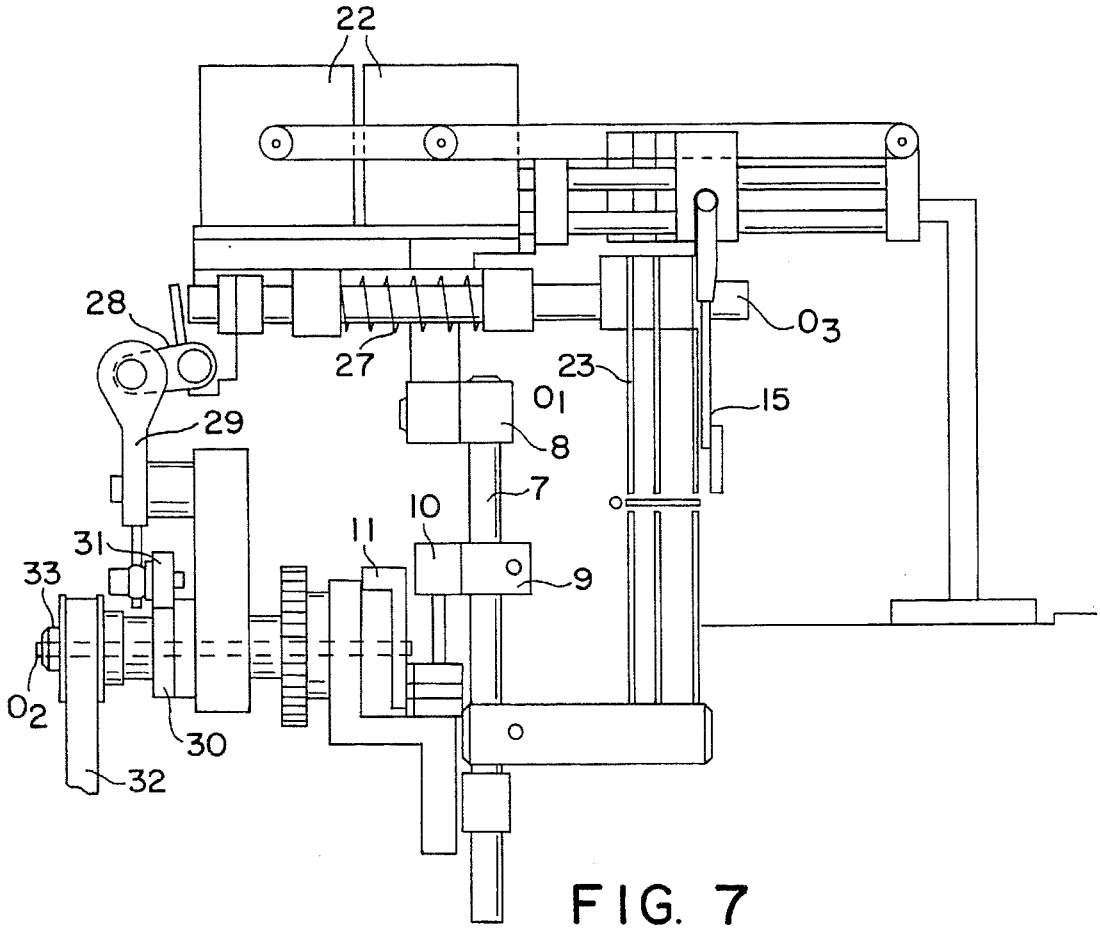
FIG. 7 is a side view corresponding to FIG. 5.

It should be noted that the shaft (O3) is always in abutment, in particular by means of a spring (27), on the anvil of a return lever (28). This lever (28) is coupled to a coupling rod (29) which receives its motion through a cam (30), via a follower roller (31) carried by the coupling rod. These various movements are provided by the motor of the loom, in particular through a toothed belt (32) and a toothed wheel (33) mounted on the shaft (02) (FIG. 7).

Figure 2:
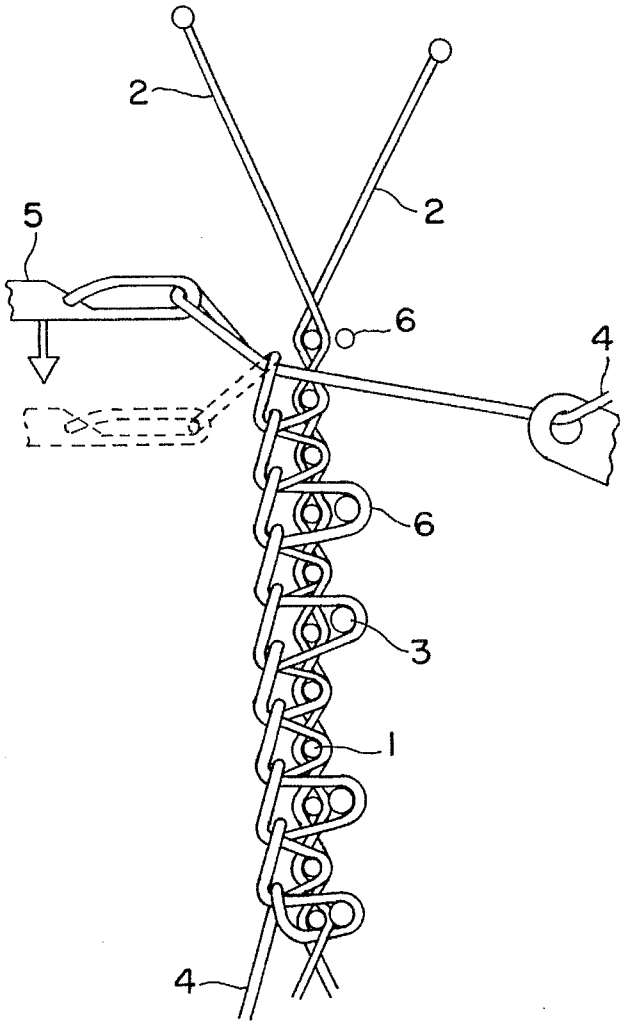
FIG. 2 is a view in transverse cross section taken on the line 2.2 in FIG. 1.

The needles (5) being at the top dead center, the binding guides (23) are displaced through one step of the straight line movement of the needles (5), the effect of which is to cause the locking mesh yarn (4) to be laid by causing it to penetrate into an arrangement of the needles (5), for example below the point of this needle (FIG. 2). At that instant, the needles (5) begin their descent, as do the binding guides, carrying in their movement the yarn (4) which forms a loop that passes into the previously formed mesh so as to create a new mesh.

When the needles reach the bottom dead center, they are displaced as described above in order to avoid the sley and to complete the anchoring of the decorative weft (6).

In accordance with another feature of the invention, the device includes picot hooks (34) arranged at the level of the end of the needles (5) and yarn guides (15) that receive the decorative weft. These picot hooks (34) are controlled by any known and suitable system for giving them a rectangular motion. The effect of these picot hooks is to detain the yarns (6) of the decorative effect temporarily during the travel of the yarn guides (15), for example at the instant when the loop is formed. It should be noted that the device has two picot hooks (34) working alternately (FIG. 5). The motion of the picot hooks is linked with that of the yarn guides (15), and it controls the width of the loop.

Figure 9:
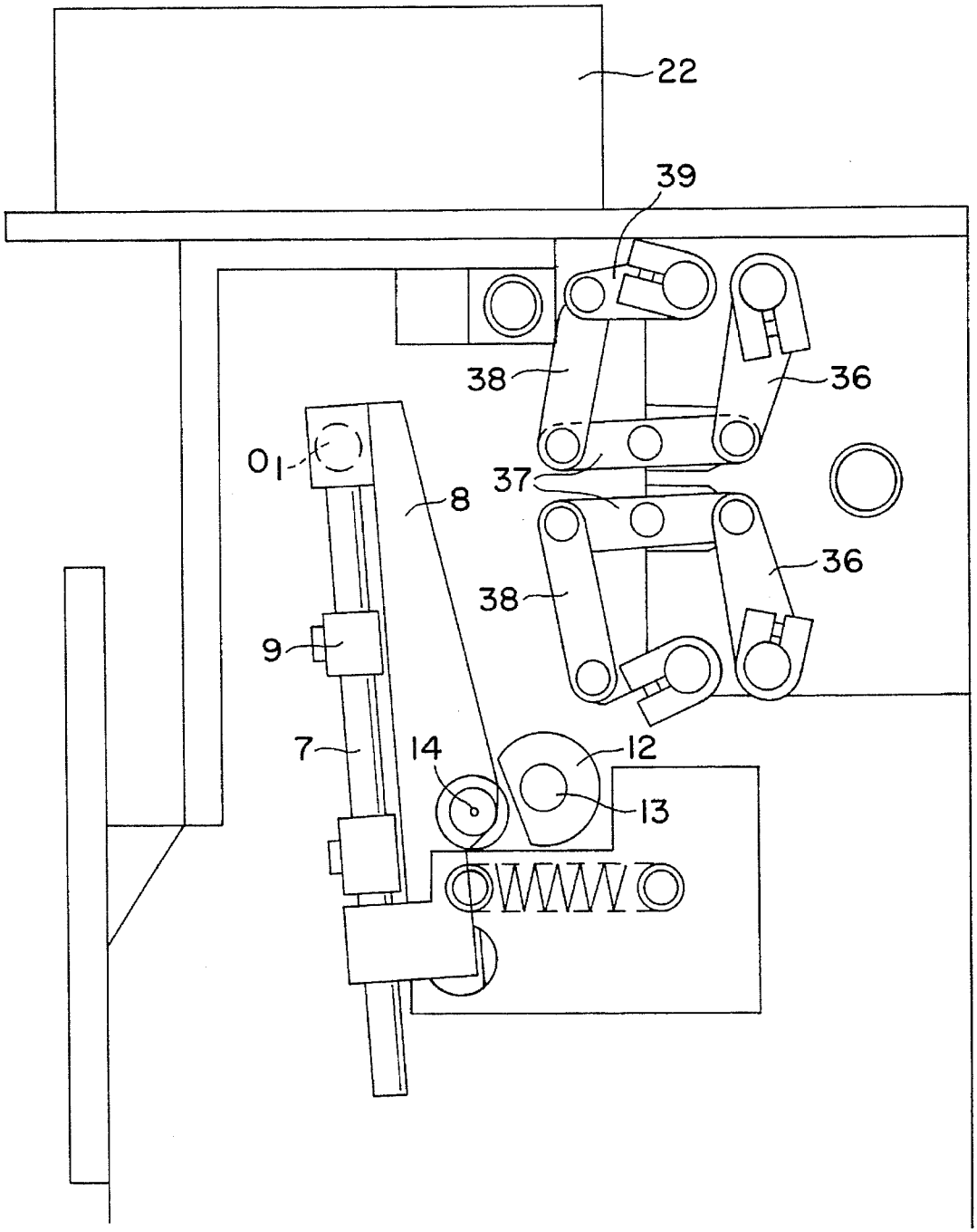
FIG. 9 is a front view showing, in particular, the control means for the members adapted for the temporary detention of the weft or wefts of the decorative effect.
Figure 10:
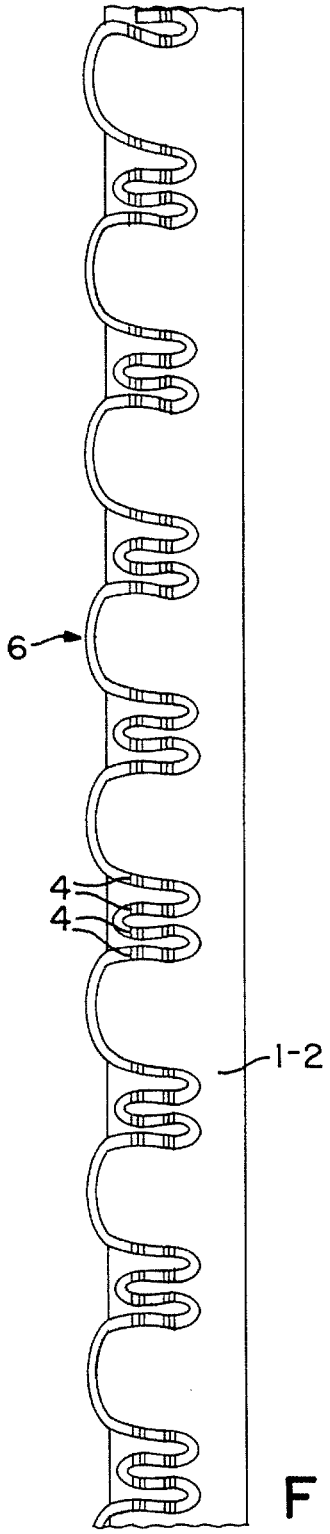
FIG. 10 is a top view showing one embodiment of an article made by the process of the invention.

In the example shown, the picot hooks (34) are mounted in a support (35) and are actuated by a system of deformable parallelograms consisting of cranks (36) (37) (38) (39) (FIG. 9).

Figure 15:
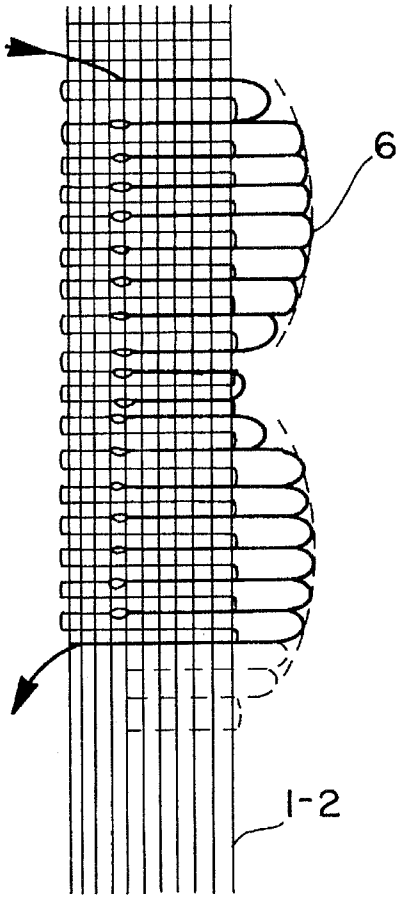
FIG. 15 is a top view showing, by way of example, one embodiment of loops having different amplitudes, as a function of the selected program.

It should be noted that this mechanical system may replace an electronic control unit which acts either on a motor having angular motion, or on an electromagnet acting on the back-and-forth travel of the picot hook. Such a system is controlled by the programme described above. A similar electronic control unit displaces the picot hook, or not, at right angles to the warp yarn, moving further away from or closer to the latter so as to form loops of different amplitudes in accordance with the chosen programme, as is for example shown in FIG. 15. Quite clearly, this Figure should not be regarded as limiting.

The advantages will appear clearly from the description, but the following in particular will be emphasized and recapitulated:

the possibility of using a shuttleless loom, thus giving a very high weaving speed;

flexibility of weaving;

the possibility of modifying at will the decorative effect or effects, according to the program;

the quality of the product obtained; and the possibility of adapting the device for any type of loom.

We claim:

1. Method for automatically manufacturing a textile backing on an automatic loom, the textile backing having weft yarns and warp yarns, a warp yarn lap and a decorative weft, comprising:

providing bonding needles, locking mesh yarn and binding guides for forming a locking mesh having a plurality of loops, raising the bonding needle across the warp yarn lap of the textile backing, retracting the bonding needles under the textile backing, inserting the decorative weft at right angles to the warp yarns of the textile backing, shifting and raising the bonding needles and simultaneously shifting the locking mesh yarn in a circular arc using binding guides so as to twill the path of the bonding needles, thereby forming the locking mesh and flattening the decorative weft against the bonding needles, shifting the binding guides to a top dead center position and displacing the locking mesh in translation at right angles to the warp, simultaneously lowering the needles and the binding guides thereby carrying the locking mesh yarn and creating a loop of the locking mesh which encloses the decorative weft, wherein the decorative weft is held by the locking mesh so as to define portions of a floating decorative weft parallel to the warp, thereby constituting loops of decorative weft which are variable in amplitude and length, in accordance with a predetermined program and wherein the textile backing is simultaneously formed along with the decorative effect.

2. Device for automatically manufacturing a textile backing on an automatic loom, the textile backing having weft yarns and warp yams, a warp yarn lap and at least one decorative weft, comprising:

means for distributing the at least one decorative weft, means for moving at least one bonding needle for forming a locking mesh in a back-and-forth motion so as to subject said bonding needle to vertical motion in a straight line, at least one binding guide and means for moving the at least one binding guide to receive a yarn of the locking mesh in an are of a circle which crosses a path of the at least one bonding needle, means for moving at least one picot hook in a rectangular motion, said picot hook being operable to temporarily detain the at least one decorative weft; and first programmable control means adapted to act on the means for distributing the at least one decorative weft so that said decorative weft can be programmably displaced.

3. Device as claimed in claim 2, wherein the means for distributing the at least one decorative weft has at least one yarn guide supporting said decorative weft, said yarn guide being coupled to a transfer carriage adapted to be displaceable in straight line motion.

4. Device as claimed in claim 3, wherein the transfer carriage coupled to the at least one yarn guide cooperates with a drive system coupled to an electronically controlled stepping motor and is displaceable, on a guide bar, at right angles to the warp yarns of the textile backing.

5. Device as claimed in claim 2, wherein the means for moving the at least one bonding needle comprises an oscillating support operable to receive the bonding needle, the bonding needle being mounted in a needle rod, said oscillating support cooperating with a means for oscillation operable to move said bonding needle in a back-and-forth motion so as to subject said bonding needle to said vertical motion in a straight line.

6. Device as claimed in claim 2, wherein the means for moving the at least one binding guide comprises a crank arm and crank system under control of an oscillating support, said crank being coupled to a shaft on which said binding guide is mounted.

7. Device as claimed in claim 2, wherein the means for moving the at least one picot hook in rectangular motion comprises at least one of a deformable parallelogram system and a second electronic programmable control system.

8. Device as claimed in claim 2, wherein the first programmable control means adapted to act on the means for distributing the at least one decorative weft comprises a stepping motor controlled electronically by a central program unit which integrates at least two parameters, namely a weft amplitude, following a displacement of the means for distributing the at least one decorative weft in a direction at right angles to the warp yarns, and a frequency of movements of the means for distributing the at least one decorative weft.

* * * * *